US007448088B2

(12) United States Patent
Miller

(10) Patent No.: US 7,448,088 B2
(45) Date of Patent: Nov. 11, 2008

(54) KNEE PAD

(75) Inventor: Jon B. Miller, Fullerton, CA (US)

(73) Assignee: Custom Building Products, Inc., Seal Beach, CA (US)

( * ) Notice: Subject to any disclaimer, the term of this patent is extended or adjusted under 35 U.S.C. 154(b) by 126 days.

(21) Appl. No.: 11/473,683

(22) Filed: Jun. 22, 2006

(65) Prior Publication Data

US 2007/0294805 A1 Dec. 27, 2007

(51) Int. Cl.
*A41D 13/00* (2006.01)

(52) U.S. Cl. ..... 2/24

(58) Field of Classification Search ..... 2/23, 2/24, 16, 267, 455, 911; 602/23, 26, 62
See application file for complete search history.

(56) References Cited

U.S. PATENT DOCUMENTS 2,759,189 A * 8/1956 Cole ..... 2/24
4,484,361 A * 11/1984 Leighton et al. ..... 2/24
4,772,071 A 9/1988 Richards
4,876,745 A 10/1989 Richards
5,031,240 A * 7/1991 Nierhaus ..... 2/24
5,090,055 A * 2/1992 McElroy ..... 2/24
5,711,029 A 1/1998 Visco et al.
5,870,774 A * 2/1999 Legenstein ..... 2/24
6,553,572 B2 * 4/2003 Fiorini et al. ..... 2/22
6,584,616 B2 * 7/2003 Godshaw et al. ..... 2/24
6,820,279 B2 * 11/2004 Lesosky ..... 2/24
7,062,787 B1 * 6/2006 Shircliff ..... 2/24
7,181,770 B2 * 2/2007 Godshaw ..... 2/24

* cited by examiner

*Primary Examiner*—Tejash Patel
(74) *Attorney, Agent, or Firm*—Fulwider Patton LLP

(57) ABSTRACT

A knee pad for attachment to a person's knee cap and an adjacent portion of the person's lower leg, comprising a cushioning pad that includes a forward section and a rearward section. The forward section has a knee well for receiving the person's knee cap and the knee well is off-center in the forward section. The rearward section of the cushioning pad has an interior concavity for receiving the person's lower leg.

6 Claims, 2 Drawing Sheets

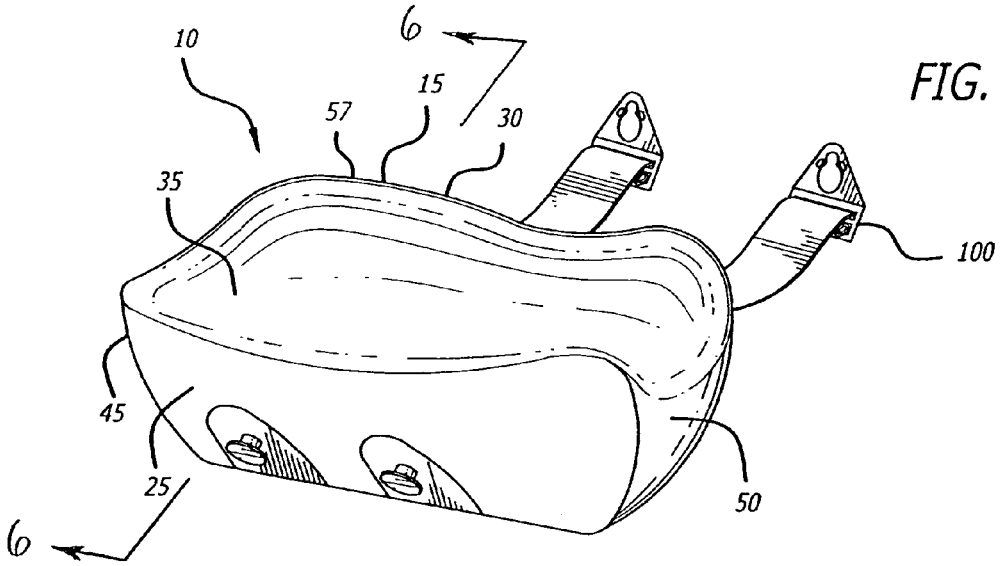
FIG. 4
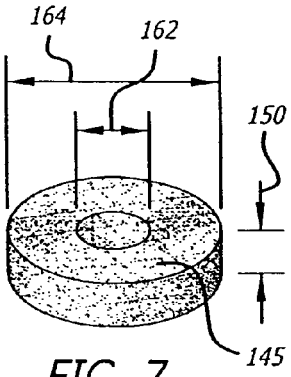
FIG. 7
FIG. 5
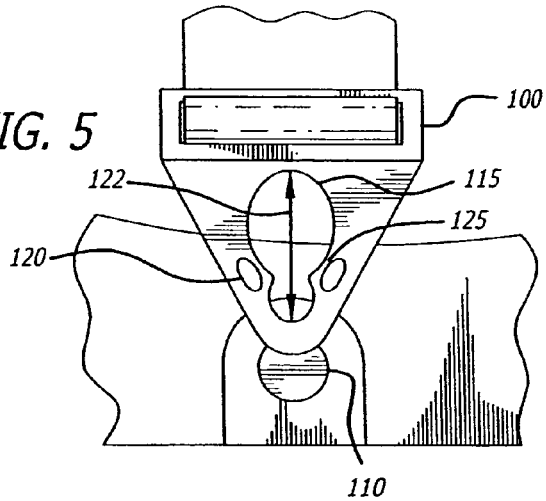
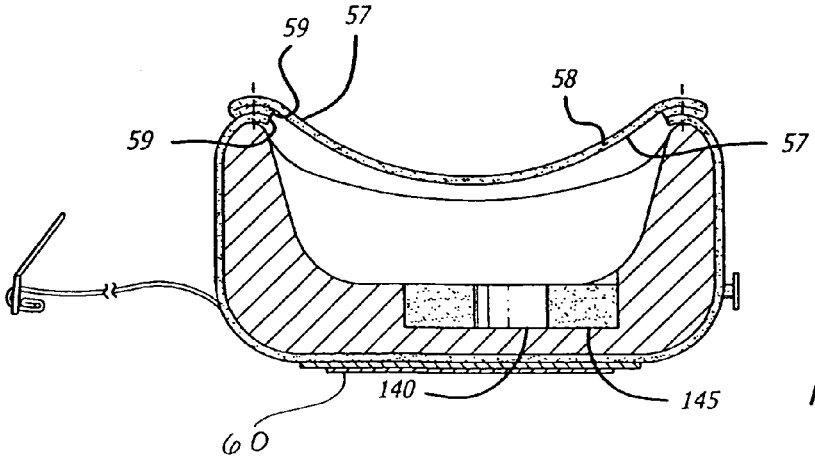
FIG. 6

KNEE PAD

FIELD OF THE INVENTION

This invention relates generally to knee pads or rests, and more particularly relates to a knee pad having a forward section for cushioning a person's knee, and a rearward section for cushioning at least a portion of a person's lower leg.

BACKGROUND OF THE INVENTION

A major ailment associated with prolonged excessive pressure on the knee is patellar bursitis, also known as miners' knee or housemaid's knee. Bursitis occurs when the bursa sack (a protective cushioning sack) over the kneecap becomes inflamed, swells and becomes painful. Over time, major knee problems will develop when the cartilage and tissue (meniscus) cushion located between the bones of the knee joint wear out causing bone to wear against bone. Additionally, the excessive pressure can cause a variety of problems including knee burn pain, fluid build up, tissue swelling, loose joints and associated arthritic conditions.

A solution to those problems is for a person to wear knee pads. Knee pads can be used to dissipate energy that could otherwise be absorbed by the front portion of the knees. While a knee pad may provide a softer surface than a floor or the ground, the pads themselves may lead to discomfort after prolonged use. Improvements in knee pads have included contours in the pads to conform to the wearer's knees.

One type of knee pad known in the art includes a hard shell designed to rest against a floor or ground surface and a cushioning pad secured between the shell and the front portion of the user's knee. In this arrangement, the knee undergoes considerable stress from pressure. Knee pads are typically secured to the legs by straps above and below the knee joints. While these provide a cushion for the knee joint area, the straps often bind behind the knee causing discomfort.

It is therefore desirable for a knee pad to have straps that do not bind behind the knee, that will not inhibit a user from walking comfortably while wearing the kneepad, and that will minimize the stress on a user's knee in general. It would also be desirable to provide a knee pad having a forward section for protecting a front portion of a user's knee, as well as a rearward section for protecting at least a portion of the user's lower leg below the user's knee. The present invention meets these and other needs.

SUMMARY OF THE INVENTION

The invention relates to a knee pad for attachment to a person's knee cap and an adjacent portion of the person's lower leg below the person's knee cap. The knee pad has a cushioning pad including a forward section and a rearward section. In one presently preferred aspect, the forward section has a knee well for receiving the person's knee cap and the rearward section of the cushioning pad has an interior concavity or channel for receiving the person's lower leg. In another presently preferred aspect, the knee well is off-center in the forward section and includes a knee cap cushioning ring that is made up of an elastomeric material. A means for connecting the cushioning pad to the person's knee and the adjacent portion of the person's lower leg typically includes two connectors on one of two opposing lateral sides of the knee pad, and first and second straps connected to and extending from the other of the two opposing lateral sides. The first strap extends from the other of the opposing lateral sides of the forward section, and has a distal end with a fastener adapted to be removably connected to one of the two connectors. The second strap extends from the rearward section and the same lateral side as the first strap and is adapted to extend behind the person's lower leg. The second strap has a distal end with a fastener adapted to be removably connected to the other of the two connectors.

In another presently preferred aspect, the cushioning pad further includes a joint connecting the forward section and rearward section along a longitudinal axis of the knee pad. The joint allows for bending of the pad about a transverse axis substantially perpendicular to the longitudinal axis. The joint may be a living hinge, a thinning of the cushioning pad or a groove between the forward and rearward sections. In another presently preferred aspect, the knee pad includes a cover that envelops the cushioning pad. Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENTS

Figure 1:
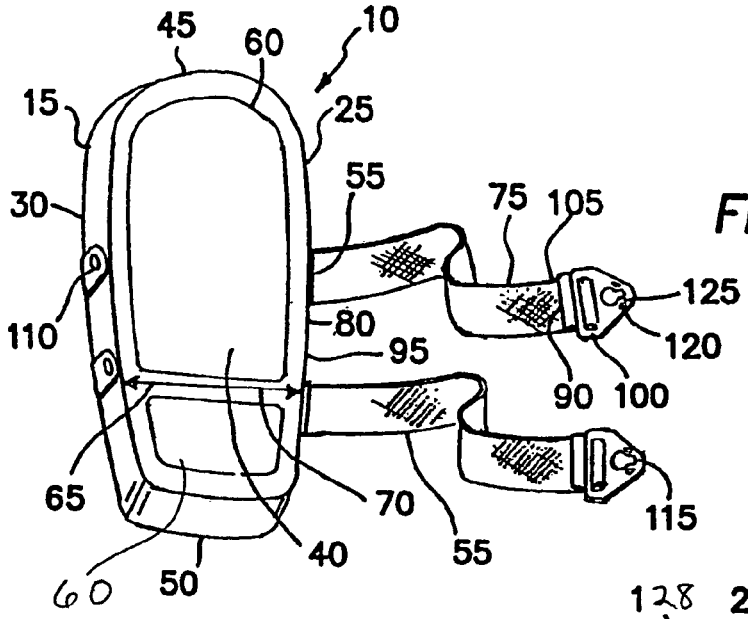
FIG. 1 is a bottom plan view of the bottom side of the knee pad showing the flexible outer covering and means for attaching the knee pad to a wearer.

Referring to the drawings, which are provided for purposes of illustration and by way of example, the present invention provides for a knee pad 10 for attachment to a person's knee cap (not shown) and an adjacent portion of the person's lower leg below the person's knee. An embodiment of the knee pad 10 includes an outer flexible covering 15 and a weight distributing cushioning pad 20. The outer flexible covering 15 may be formed from a stretchable material or fabric, such as nylon or polyester, as well as a non-stretchable material such as nylon, for example, for greater durability. The knee pad 10 has left 25 and right 30 sides, top 35 and bottom 40 faces and a front 45 and rear 50 side. The left 25 and right 30 sides include a means 55 for securing the knee pads 10 to a person's knee and adjacent portion of the person's lower leg below the person's knee.

Figure 6:
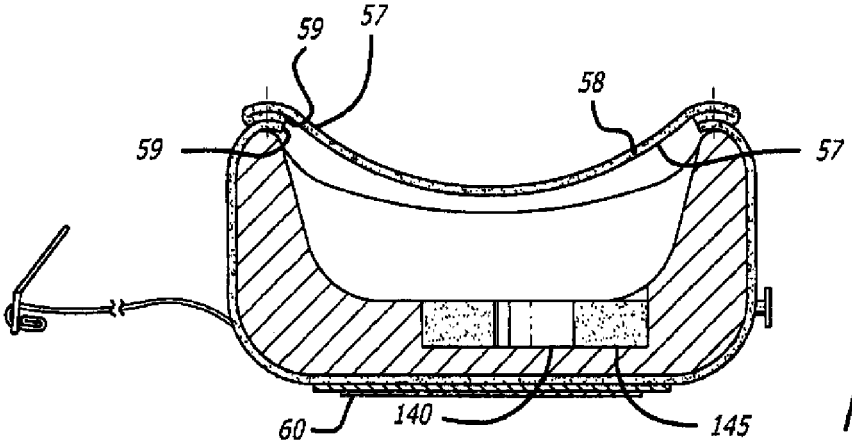
FIG. 6 is a sectional view of the knee pad taken along the line 6-6 of FIG. 4.

Referring to FIG. 6, in a presently preferred aspect, the majority of the covering 15 is composed of two outer layers made of fabric 57, such as nylon or polyester, for example, which is capable of stretching and is substantially water resistant. The inner layer 58 is made of foam, such as polyester foam or polyurethane foam, for example, that is capable of stretching and is substantially water resistant. The covering 15 is preferably formed to be relatively soft, non-abrasive and conforming. Portions of the outer covering 15, such as the rear side portion 50, may be formed of a more durable non-stretchable fabric, such as nylon, for example. Indicia, such as to indicate whether a particular pad 10 is a left or right knee pad may also be placed anywhere on the surface of the covering 15. The inside of the cover may include seams where portions of the outer cover 15 are joined 59, that also serve to substantially hold the cover 15 in registration with the weight dispersing cushioning pad 20.

Turning to FIGS. 1 and 6, the bottom face 40 of the covering 15 has two distinct raised areas 60. The areas 60 have a textured surface, such as a durable rubber layer for example, to facilitate traction between the knee pad 10 and a work surface such as a floor. The rubber layer is significantly more durable than the rest of the covering 15 and serves as an extra wear surface for contact with a floor or the ground. As shown in FIG. 1, between the raised areas 60 is a valley 65 which helps to allow the knee pad to bend along a lateral axis 70. The ability to bend has, among other advantages, the advantage of allowing the knee pad to more effectively cushion the wearer's weight and distribute a wearer's weight over an uneven surface.

Figure 5:
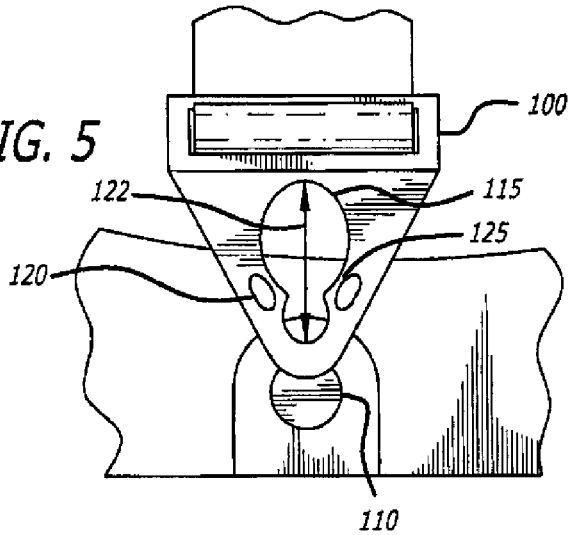
FIG. 5 is an exploded view of the strap and stud combination illustrating how the knee pad is secured.

The knee pad 10 also has means 55 for securing the pad 10 to the wearer, such as straps 75, connected to the flexible covering 15 of the knee pad 10 between the bottom face 40 at the side face 25 along the instep 80 of the particular right or left pad. The straps 75 are preferably made of an elastic material. The straps 75 are attached to the knee pad 10 parallel to each other and spaced apart by a distance 95, typically from one to four inches. The straps 75 are adjustable and may be used with a removable length adjustor end piece 100, connected to an end portion 105 of the straps, that is also removably securable to the pad 10. Each end piece 100 removably connects to a stud 110 secured to the side face 30, opposite the instep 80. Referring to FIG. 5, the end piece 100 has a slot or cutout 115 sized and shaped to receive the stud 110 and lock into place. The cutout 115 on the end piece 100 is optimally designed to allow the end piece 100 to remain locked to the stud until a sufficient amount of force is applied to overcome the lock. Two smaller cutouts 120, spaced symmetrically on either side of a medial line 122 along the cut out 115 function to allow a pair of bridge portions 125 of the end piece to resiliently bend to allow the end piece to be removably locked to the stud 110.

Figure 2:
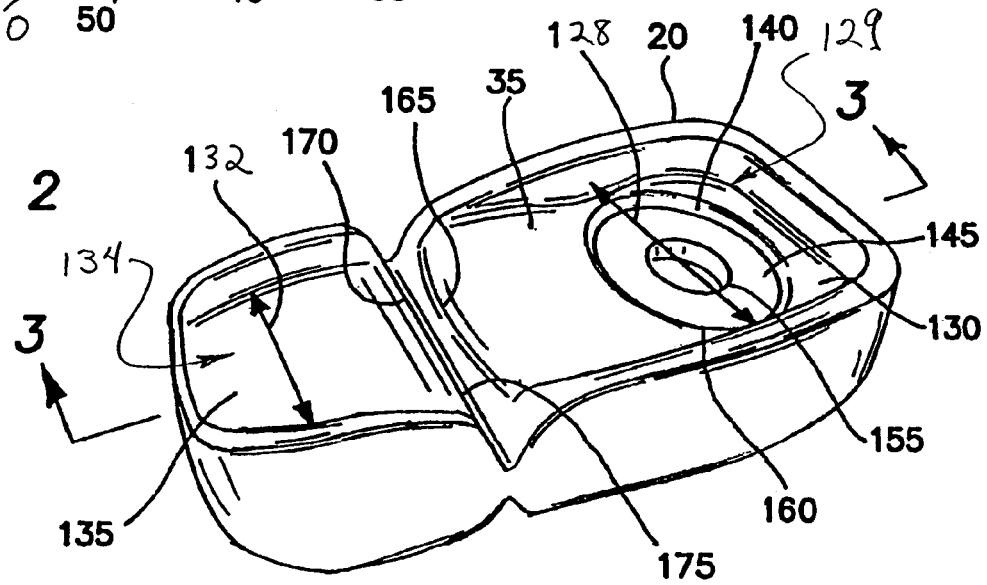
FIG. 2 is a perspective view of the cushioning pad of the knee pad of FIG. 1.

Referring to FIG. 2, the weight distributing cushioning pad 20 is disposed inside the flexible outer covering 15. The cushioning pad is typically formed of a durable foam such as polyurethane foam, and exists either as a right oriented or left oriented pad for the wearer's respective right or left knee (not shown). The cushioning pad 20 is typically tapered, with a largest lateral interior width 128 in a concavity or channel 129 at a forward portion 130 of the pad 10, and a smallest lateral interior width 132 in a concavity or channel 134 at a rear portion 135 of the cushioning pad 20.

Figure 7:
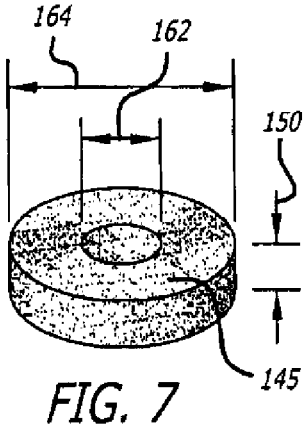
FIG. 7 is a perspective view of the insert.

In the forward portion 130 is a well 140, that may be circular, oval, square or any combination of shapes. Inside the well is an insert 145 for placement of a knee thereon, forming a knee well that in a presently aspect is off-center in the forward position. The insert 145 may be made of a different, softer material than that of the rest of the cushioning pad 20 such as a softer polyester or polyurethane foam, for example. The insert 145 is in the shape of an annular ring or cylindrical doughnut with a height 150, inner 155 and outer 160 circumference and inner 162 and outer 164 diameters as is illustrated in FIG. 7. The insert 145 may be integral with the cushioning pad 20 or may be secured to the well 140 of the pad 20 with an appropriate adhesive or fastener.

Figure 3:
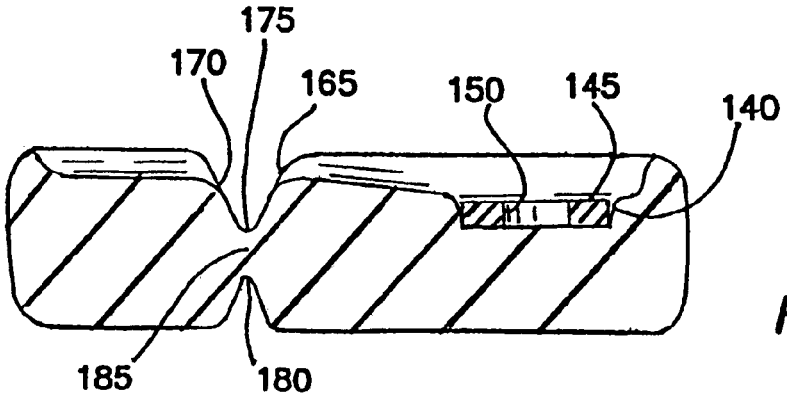
FIG. 3 is a sectional view of the cushioning pad taken along the line 3-3 of FIG. 2.
Figure 1:
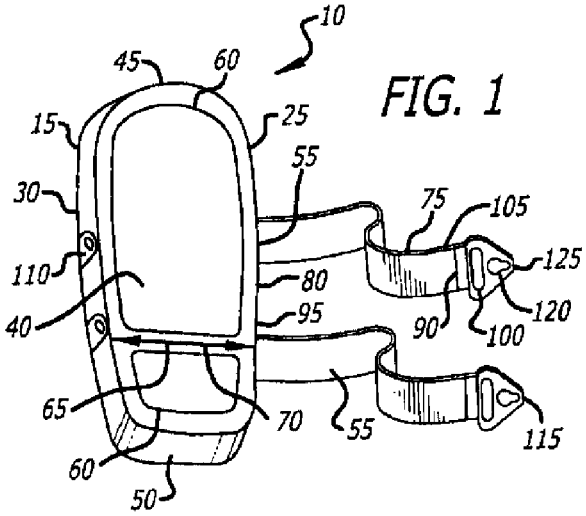
Figure 2:
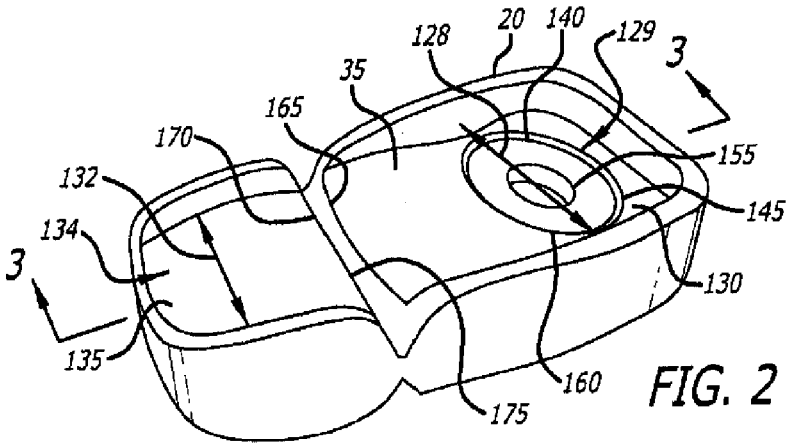
Figure 3:
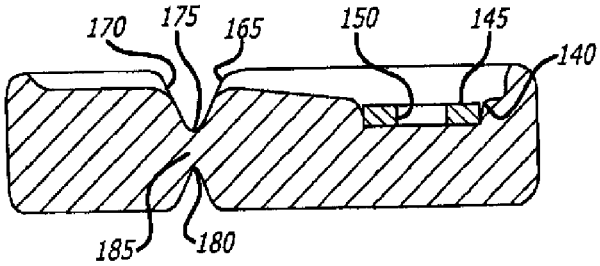
Figure 4:
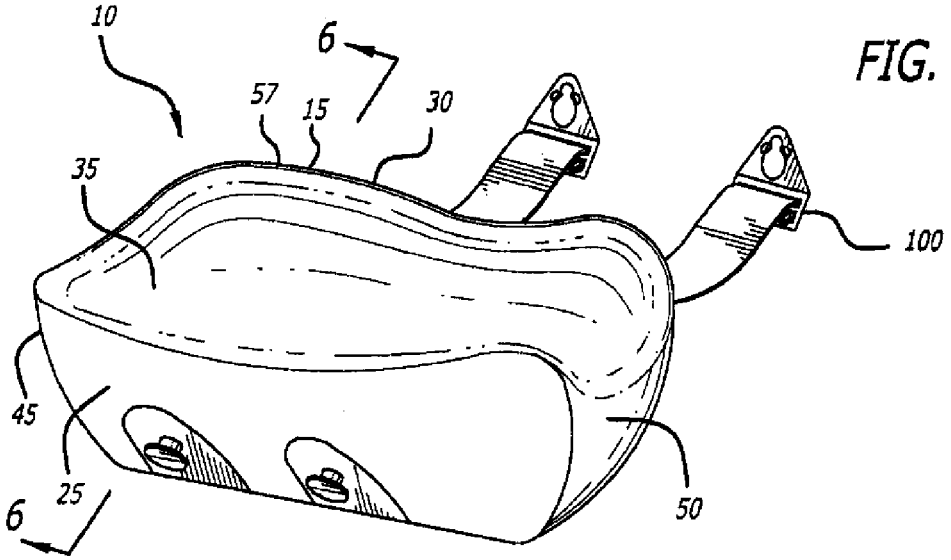
FIG. 4 is a perspective view of the top and side of the knee pad of FIG. 1.

Referring to FIG. 3, the forward portion 130 gradually slopes up to a medial edge 165. The medial edge 165 faces an opposite medial edge 170 that preferably together define an upper valley 175 therebetween. The bottom face 40 also preferably has a second valley 180 that together with the upper valley 175 form a joint 185 that allows the cushioning pad 20 and knee pad 10 to flex along a lateral axis 70. The advantages of the pad 10 being able to flex in this manner are improved durability and comfort of the pad 10, especially when the pad 10 is used over uneven surfaces. Adjacent the upper valley 175 is the rear portion 135 having an upper surface that has a concave shape or channel to accept a wearer's shin (not shown) and distribute the weight of a wearer evenly.

While the foregoing specification describes particular embodiments of the present invention, those of ordinary skill can devise variations of the present invention without departing from the inventive concept. Accordingly, it is not intended that the invention be limited, except as by the appended claims.

I claim:

1. A knee pad for attachment to a person's knee cap and an adjacent portion of the person's lower leg, comprising:

a cushioning pad, including a forward section and a rearward section, the forward section having a knee well for receiving the person's knee cap, the knee well being off-center and including a knee cap cushioning ring, and the rearward section of the cushioning pad having an interior channel for receiving the person's lower leg, the forward and rearward sections are connected together along a longitudinal axis by a joint for bending about a transverse axis substantially perpendicular to the longitudinal axis, said cushioning pad having an outer surface defining opposing upper and lower valleys defining said joint; and a means for connecting the cushioning pad to the person's knee and the adjacent portion of the person's lower leg.

2. The knee pad of claim 1 wherein the cushioning pad further comprises a flat bottom.

3. The knee pad of claim 1 wherein the knee cap cushioning ring is made up of an elastomeric material.

4. The knee pad of claim 1 wherein the means for connecting the cushioning comprises at least two straps spaced apart.

5. The knee pad of claim 4 further comprising at least two studs.

6. The knee pad of claim 1 further comprising a cover that envelops the cushioning pad.

* * * * *

UNITED STATES PATENT AND TRADEMARK OFFICE

CERTIFICATE OF CORRECTION

PATENT NO. : 7,448,088 B2
APPLICATION NO. : 11/473683
DATED : November 11, 2008
INVENTOR(S) : Jon B. Miller It is certified that error appears in the above-identified patent and that said Letters Patent is hereby corrected as shown below:

Title Page.
The Title page drawing should be replaced with the attached Figure 6 drawing.

The sheet of drawings consisting of figures 1-7 should be deleted and replaced with the sheets of formal drawings Figures 1-7.

Signed and Sealed this

Fifth Day of January, 2010

David J. Kappos

David J. Kappos
*Director of the United States Patent and Trademark Office*

(12) United States Patent
Miller

(10) Patent No.: US 7,448,088 B2
(45) Date of Patent: Nov. 11, 2008

(54) KNEE PAD

(75) Inventor: Jon B. Miller, Fullerton, CA (US)

(73) Assignee: Custom Building Products, Inc., Seal Beach, CA (US)

( * ) Notice: Subject to any disclaimer, the term of this patent is extended or adjusted under 35 U.S.C. 154(b) by 126 days.

(21) Appl. No.: 11/473,683

(22) Filed: Jun. 22, 2006

(65) Prior Publication Data

US 2007/0294805 A1 Dec. 27, 2007

(51) Int. Cl.
*A41D 13/00* (2006.01)

(52) U.S. Cl. ..... 2/24

(58) Field of Classification Search ..... 2/23, 2/24, 16, 267, 455, 911; 602/23, 26, 62
See application file for complete search history.

(56) References Cited

U.S. PATENT DOCUMENTS

| | | | | |
|---|---|---|---|---|
| 2,759,189 | A * | 8/1956 | Cole | 2/24 |
| 4,484,361 | A * | 11/1984 | Leighton et al. | 2/24 |
| 4,772,071 | A | 9/1988 | Richards | |
| 4,876,745 | A | 10/1989 | Richards | |
| 5,031,240 | A * | 7/1991 | Nierhaus | 2/24 |
| 5,090,055 | A * | 2/1992 | McElroy | 2/24 |
| 5,711,029 | A | 1/1998 | Visco et al. | |
| 5,870,774 | A * | 2/1999 | Legenstein | 2/24 |
| 6,553,572 | B2 * | 4/2003 | Fiorini et al. | 2/22 |
| 6,584,616 | B2 * | 7/2003 | Godshaw et al. | 2/24 |
| 6,820,279 | B2 * | 11/2004 | Lesosky | 2/24 |
| 7,062,787 | B1 * | 6/2006 | Shircliff | 2/24 |
| 7,181,770 | B2 * | 2/2007 | Godshaw | 2/24 |

* cited by examiner

*Primary Examiner*—Tejash Patel
(74) *Attorney, Agent, or Firm*—Fulwider Patton LLP

(57) ABSTRACT

A knee pad for attachment to a person's knee cap and an adjacent portion of the person's lower leg, comprising a cushioning pad that includes a forward section and a rearward section. The forward section has a knee well for receiving the person's knee cap and the knee well is off-center in the forward section. The rearward section of the cushioning pad has an interior concavity for receiving the person's lower leg.

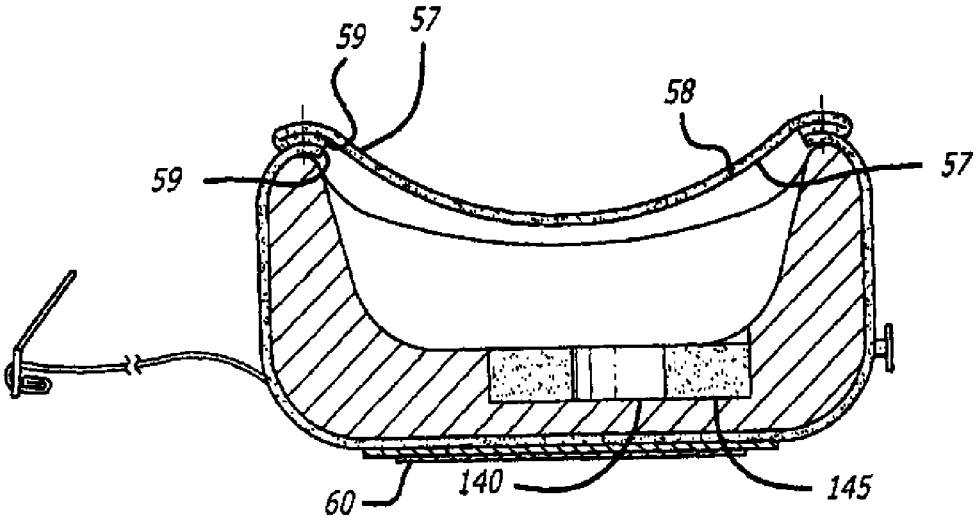

6 Claims, 2 Drawing Sheets